US009951997B2

(12) United States Patent
Maurer et al.

(10) Patent No.: US 9,951,997 B2
(45) Date of Patent: Apr. 24, 2018

(54) STAGED GRAPHITE FOAM HEAT EXCHANGERS

(75) Inventors: Scott M. Maurer, Haymarket, VA (US); James W. Klett, Knoxville, TN (US)

(73) Assignee: Lockheed Martin Corporation, Bethesda, MD (US)

( * ) Notice: Subject to any disclaimer, the term of this patent is extended or adjusted under 35 U.S.C. 154(b) by 1186 days.

(21) Appl. No.: 13/365,460

(22) Filed: Feb. 3, 2012

(65) Prior Publication Data

US 2012/0199330 A1 Aug. 9, 2012

Related U.S. Application Data

(60) Provisional application No. 61/439,565, filed on Feb. 4, 2011.

(51) Int. Cl.
*F28D 3/02* (2006.01)
*F25B 39/02* (2006.01)
(Continued)

(52) U.S. Cl.
CPC ..... *F28D 3/02* (2013.01); *F25B 39/028* (2013.01); *F28D 3/04* (2013.01); *F28D 7/024* (2013.01);
(Continued)

(58) Field of Classification Search
CPC ... F28D 3/02; F28D 3/04; F28D 7/024; F28D 7/16; F28D 7/1669; F25B 39/028;
(Continued)

(56) References Cited

U.S. PATENT DOCUMENTS 398,645 A * 2/1889 Moore ..... 165/159
1,525,094 A 2/1925 Jones
(Continued)

FOREIGN PATENT DOCUMENTS

CN 2199467 Y 5/1995
CN 2201284 Y 6/1995
(Continued)

OTHER PUBLICATIONS

International Search Report for international application No. PCT/US2012/023786, dated Jan. 21, 2013 (4 pages).
(Continued)

*Primary Examiner* — Grant Moubry
*Assistant Examiner* — Raheena R Malik
(74) *Attorney, Agent, or Firm* — Withrow & Terranova, PLLC

(57) ABSTRACT

Shell-and-tube heat exchangers that utilize one or more foam heat transfer units engaged with the tubes to enhance the heat transfer between first and second fluids. The foam of the heat transfer units can be any thermally conductive foam material that enhances heat transfer. In an embodiment, a liquid distribution unit is employed that sprays a fluid to maximize the energy transfer through the use of large surface/volume ratio of the sprayed fluid. The spraying can be used in combination with or separately from the foam heat transfer units. Also, the tubes can be helically twisted around the liquid distribution unit so that the sprayed fluid impinges on the tubes. The shell-and-tube heat exchangers described herein are highly efficient, inexpensive to build, and corrosion resistant. The heat exchangers can be configured as an evaporator, a condenser, or for single phase cooling or heating thermal transfer applications.

29 Claims, 9 Drawing Sheets

(51) Int. Cl.

| | |
|---|---|
| ***F28D 3/04*** | (2006.01) |
| ***F28D 7/02*** | (2006.01) |
| ***F28D 7/16*** | (2006.01) |
| ***F28F 9/22*** | (2006.01) |
| ***F28F 13/00*** | (2006.01) |
| ***F28F 21/02*** | (2006.01) |

(52) U.S. Cl.
CPC ..... *F28D 7/16* (2013.01); *F28D 7/1669* (2013.01); *F28F 9/22* (2013.01); *F28F 13/003* (2013.01); *F28F 21/02* (2013.01); *F28F 2009/226* (2013.01); *F28F 2275/062* (2013.01)

(58) Field of Classification Search
CPC .. F28F 13/003; F28F 21/02; F28F 9/22; F28F 2009/226; F28F 2275/062
USPC ..... 165/159, 160, 162, 905
See application file for complete search history.

(56) References Cited

U.S. PATENT DOCUMENTS 2,429,508 A 10/1947 Belaieff
2,693,942 A * 11/1954 Guala ..... 165/161
2,792,200 A 5/1957 Huggins et al.
2,821,369 A * 1/1958 Hilliard ..... 165/159
2,834,714 A 5/1958 Denison, Jr. et al.
3,288,573 A 11/1966 Abos
3,289,757 A 12/1966 Rutledge
3,294,159 A 12/1966 Kovalik et al.
3,334,026 A 8/1967 Dobell
3,359,753 A 12/1967 Fiedler et al.
3,400,758 A 9/1968 Lee
3,489,654 A 1/1970 Geiringer
3,498,077 A 3/1970 Gerard et al.
3,595,310 A 7/1971 Burne et al.
3,630,276 A 12/1971 Paine et al.
3,818,984 A 6/1974 Nakamura et al.
4,136,428 A 1/1979 Godsey et al.
4,325,734 A 4/1982 Burrage et al.
4,347,083 A 8/1982 Sara
4,351,651 A 9/1982 Courneya
4,360,059 A 11/1982 Funke
4,418,549 A 12/1983 Courneya
4,438,809 A 3/1984 Papis
4,475,988 A 10/1984 Tsumura et al.
4,493,368 A * 1/1985 Gronnerud et al. ..... 165/159
4,697,321 A 10/1987 Shibuya et al.
4,699,211 A 10/1987 Geary et al.
4,715,438 A 12/1987 Gabuzda et al.
4,724,754 A * 2/1988 Crozat ..... A23G 3/0215 165/145
4,993,223 A 2/1991 Kretzinger
5,046,331 A 9/1991 O'Neal et al.
5,058,664 A 10/1991 Gentry
5,063,663 A 11/1991 Casterline
5,078,206 A 1/1992 Goetz, Jr.
5,095,708 A 3/1992 Kalina
5,100,049 A 3/1992 Divecha et al.
5,113,052 A 5/1992 Gabriel
5,132,780 A 7/1992 Higgins, III
5,172,752 A 12/1992 Goetz, Jr.
5,273,106 A 12/1993 Drake
5,480,676 A 1/1996 Sonuparlak et al.
5,513,494 A 5/1996 Flynn et al.
5,582,245 A 12/1996 Niimi
5,755,280 A 5/1998 da Costa et al.
5,797,449 A 8/1998 Oswald et al.
5,832,991 A 11/1998 Cesaroni
5,878,590 A 3/1999 Kadle et al.
5,882,461 A 3/1999 Rogut
6,167,713 B1 1/2001 Hartfield et al.
6,259,165 B1 7/2001 Brewington
6,386,275 B1 5/2002 Kuo et al.
6,438,936 B1 8/2002 Ryan
6,516,627 B2 * 2/2003 Ring et al. ..... 62/471
6,537,351 B2 3/2003 Margiott et al.
6,552,902 B2 4/2003 Cho et al.
6,673,328 B1 1/2004 Klett et al.
6,694,740 B2 2/2004 Nayar
6,755,037 B2 6/2004 Engel et al.
6,763,671 B1 7/2004 Klett et al.
6,780,505 B1 8/2004 Klett et al.
6,827,138 B1 * 12/2004 Master et al. ..... 165/159
6,838,202 B2 1/2005 Brady et al.
7,013,963 B2 3/2006 Laine et al.
7,063,130 B2 6/2006 Huang
7,147,214 B2 12/2006 Klett et al.
7,306,654 B2 12/2007 King et al.
7,331,381 B2 2/2008 Wang et al.
7,401,643 B2 7/2008 Queheillalt et al.
7,431,805 B2 10/2008 Beckman
7,472,549 B2 1/2009 Brewington
7,740,057 B2 6/2010 Wang et al.
7,762,101 B1 7/2010 Zuili et al.
7,766,076 B2 8/2010 Khalili et al.
7,857,039 B2 12/2010 Nakamura
8,020,610 B2 9/2011 Soldner et al.
8,272,431 B2 9/2012 Campagna et al.
8,567,195 B2 10/2013 Nash
8,800,849 B2 8/2014 Jansen et al.
9,080,818 B2 7/2015 Maurer et al.
2002/0017108 A1 2/2002 Schooley
2002/0121359 A1 9/2002 Heikkila et al.
2003/0000486 A1 1/2003 Ott et al.
2003/0154865 A1 8/2003 Zornes
2003/0173062 A1 * 9/2003 Lomax, Jr. ..... B01J 8/008 165/82
2004/0194944 A1 10/2004 Hendricks et al.
2004/0244398 A1 12/2004 Radermacher et al.
2005/0008890 A1 1/2005 Raghunathan et al.
2005/0109493 A1 5/2005 Wu et al.
2005/0121304 A1 6/2005 Beckman
2005/0178534 A1 8/2005 Kienbock et al.
2006/0124284 A1 6/2006 Ushio et al.
2006/0162913 A1 * 7/2006 Wanni ..... F28D 7/16 165/162
2006/0237172 A1 10/2006 Lo
2006/0254757 A1 11/2006 Kamsma
2007/0119907 A1 5/2007 Rodhammer
2007/0144500 A1 6/2007 Dupree et al.
2007/0175609 A1 8/2007 Christ et al.
2007/0199683 A1 8/2007 Emrich
2007/0228109 A1 10/2007 Smith et al.
2007/0228113 A1 10/2007 Dupree et al.
2007/0284095 A1 12/2007 Wang
2008/0093059 A1 * 4/2008 Nishida ..... 165/133
2008/0149311 A1 6/2008 Liu et al.
2008/0166492 A1 7/2008 Lu et al.
2008/0196869 A1 * 8/2008 Behrens et al. ..... 165/104.33
2008/0251215 A1 10/2008 Chen
2008/0251238 A1 10/2008 Gudmundsson
2009/0126918 A1 5/2009 Campagna et al.
2009/0178790 A1 * 7/2009 Schreiber et al. ..... 165/158
2009/0218070 A1 9/2009 Fries et al.
2009/0288814 A1 11/2009 Stoia et al.
2009/0308571 A1 12/2009 Thompson
2009/0308582 A1 * 12/2009 Nagurny et al. ..... 165/167
2010/0006273 A1 1/2010 Du et al.
2010/0055478 A1 3/2010 Chaumat et al.
2010/0181054 A1 7/2010 Nagurny et al.
2010/0314081 A1 12/2010 Reis et al.
2010/0318437 A1 12/2010 Yee et al.
2011/0011570 A1 1/2011 Levings et al.
2011/0011572 A1 1/2011 Nagurny et al.
2011/0016906 A1 1/2011 Zuili et al.
2011/0079375 A1 4/2011 Nagurny et al.
2011/0127022 A1 6/2011 Eller et al.
2012/0091729 A1 4/2012 Nash
2012/0177488 A1 7/2012 Corman
2012/0199331 A1 8/2012 Maurer et al.
2012/0199334 A1 8/2012 Maurer et al.
2012/0199335 A1 8/2012 Maurer

(56) References Cited

U.S. PATENT DOCUMENTS

| | | | |
|---|---|---|---|
| 2012/0282454 | A1 | 11/2012 | Jansen et al. |
| 2013/0146250 | A1 | 6/2013 | Eller et al. |
| 2013/0146437 | A1 | 6/2013 | Maurer et al. |

FOREIGN PATENT DOCUMENTS

| | | | | |
|---|---|---|---|---|
| CN | 1149707 | A | | 5/1997 |
| CN | 1276515 | A | | 12/2000 |
| DE | 854 658 | | | 11/1952 |
| DE | 1117148 | B | | 11/1961 |
| DE | 11 61 922 | | | 1/1964 |
| DE | 3615300 | A1 | | 11/1987 |
| DE | 19850557 | A1 | | 5/2000 |
| DE | 10221138 | A1 | | 2/2004 |
| EP | 1553379 | A1 | | 7/2005 |
| EP | 2124009 | A2 | | 11/2009 |
| GB | 2424265 | A | | 9/2005 |
| JP | 03207993 | A | * | 9/1991 |
| JP | 2009005683 | A | | 1/2009 |
| WO | 9966136 | A1 | | 12/1999 |
| WO | 2004027336 | A1 | | 4/2004 |
| WO | 2008042893 | A2 | | 4/2008 |
| WO | 2009137653 | A2 | | 11/2009 |
| WO | 2010116230 | A2 | | 10/2010 |

OTHER PUBLICATIONS

Written Opinion for international application No. PCT/US2012/023786, dated Jan. 21, 2013 (6 pages).

Author Unknown, "500F Thermally Conductive Epoxies," located online at www.cotronics.com/vo/cotr/ea_thermallyconductive.htm, 2008, Cotronics Corp., 2 pages.

Author Unknown, "Closed Cycle Ocean Thermal Energy Conversion (OTEC)," Renewable Energy Sources, newenergyportal.wordpress.com/2009/12/15/closed-cycle-ocean-thermal-energy-conversion-otec/, Dec. 15, 2009, 4 pages.

Author Unknown, "Vahterus PSHE Series Plate and Shell Heat Exchangers," product description, TI-P228-01, CH Issue 1, located online at www.spiraxsarco.com/pdfs/TI/p228_01_pdf, Spirax Sarco, 2007, 2 pages.

Author Unknown, "S-Bond Technology: Foams," located online at www.s-bond.com/SolderJointStructures/Foams.htm, S-Bond Technologies, accessed May 16, 2016, 2 pages.

Author Unknown, "The Fiberglass Advantages," Fiberglass Fabrication, Jun. 23, 2003 (date obtained using wayback machine), Structural Fiberglass Inc., www.structuralfiberglass.com/advant, 1 page.

Author Unknown, "Graphite Foam," Oak Ridge National Laboratory, Issue 174, Section: Smart Technology, Apr. 2, 2002, http://www.autospeed.com/cms/title_Graphite-Foam/A_1339/printArticle.html, 4 pages.

Author Unknown, "Main Thermocline," Aerographer/Meteorology, Apr. 15, 2003 (date obtained using wayback machine), Integrated Publishing, Inc., www.tpub.com/weather3/1-21, 2 pages.

El-Dessouky, H. et al., "Plastic/compact heat exchangers for single-effect desalination systems," Desalination 122, 1999, pp. 271-289.

Harrison, Sara, "Ocean Thermal Energy Conversion," Submitted as coursework for Physics 240, Stanford University, Nov. 28, 2010, large.stanford.edu/courses/2010/ph240/harrison2/, pp. 1-6.

Jacobi, A.M. et al., "Novel Materials for Heat Exchangers," Air Conditioning and Refrigeration Center, Mechanical Science and Engineering, University of Illinois, ARTI Report No. 06030-01, Mar. 2008, 446 pages.

Klett, J., "High Thermal Conductivity Graphite Foams for Compact Lightweight Radiators," Oak Ridge National Laboratory, U.S. Department of Energy, www.ms.oml.gov/sections/mpsl/Cimtech/default.htm, May 9, 2002, 17 slides.

Malloy, D., "Lockheed Martin's Approach to Alternative Energy," E2DI Journal, www,e2dinternational.co.uk and www.dynamixx.co.uk, Jun. 2009, pp. 14-15.

Narayan, G. Prakash et al., "Helium as a Carrier Gas in Humidification Dehumidification Desalination Systems," Proceedings of ASME 2011 International Mechanical Engineering Congress and Exposition (IMECE), IMECE2011-62875, Nov. 11-17, 2011, Denver, Colorado, ASME, 8 pages.

Shah, Ramesh K., "Extended Surface Heat Transfer," Thermopedia, Feb. 14, 2011, www.thermopedia.com/content/750, pp. 1-8.

International Search Report and Written Opinion for International Patent Application No. PCT/US2012/023781, dated Aug. 1, 2012, 8 pages.

International Preliminary Report on Patentability for International Patent Application No. PCT/US2012/023781, dated Aug. 15, 2013, 7 pages.

Invitation to Pay Additional Fees and Partial International Search for PCT/US2012/066294, dated Aug. 1, 2013, 6 pages.

International Search Report and Written Opinion for PCT/US2012/066294, dated Oct. 25, 2013, 16 pages.

International Preliminary Report on Patentability for PCT/US2012/066294, dated May 27, 2014, 11 pages.

International Search Report and Written Opinion for PCT/US2012/068536, dated Jun. 17, 2013, 11 pages.

International Preliminary Report on Patentability for PCT/US2012/068536, dated Jun. 10, 2014, 9 pages.

Partial International Search for International Patent Application No. PCT/US2012/023783, dated Jun. 4, 2012, 2 pages.

International Search Report and Written Opinion for International Patent Application No. PCT/US2012/023783, dated Sep. 20, 2012, 13 pages.

International Preliminary Report on Patentability for International Patent Application No. PCT/US2012/023783, dated Aug. 15, 2013, 9 pages.

International Preliminary Report on Patentability for International Patent Application No. PCT/US2012/023786, dated Aug. 15, 2013, 7 pages.

International Search Report and Written Opinion for International Patent Application No. PCT/US2012/023788, dated Jul. 30, 2012, 9 pages.

International Preliminary Report on Patentability for International Patent Application No. PCT/US2012/023788, dated Aug. 15, 2013, 7 pages.

International Search Report and Written Opinion for International Patent Application No. PCT/US2012/030853, dated Jul. 3, 2012, 7 pages.

International Preliminary Report on Patentability for International Patent Application No. PCT/US2012/030853, dated Nov. 14, 2013, 6 pages.

Non-final Office Action for U.S. Appl. No. 13/365,456, dated May 22, 2014, 11 pages.

Final Office Action for U.S. Appl. No. 13/365,456, dated Dec. 5, 2014, 12 pages.

Notice of Allowance for U.S. Appl. No. 13/365,456, dated Mar. 23, 2015, 7 pages.

Non-final Office Action for U.S. Appl. No. 13/365,459, dated Mar. 26, 2015, 10 pages.

Non-final Office Action for U.S. Appl. No. 13/365,459, dated Dec. 9, 2015, 9 pages.

Notice of Allowance for U.S. Appl. No. 13/365,459 dated Jun. 9, 2016, 7 pages.

Non-Final Office Action for U.S. Appl. No. 13/708,457, dated Oct. 24, 2014, 18 pages.

Final Office Action for U.S. Appl. No. 13/708,457, dated Feb. 13, 2015, 18 pages.

Non-Final Office Action for U.S. Appl. No. 13/708,457, dated Sep. 11, 2015, 16 pages.

Final Office Action for U.S. Appl. No. 13/708,457, dated Apr. 7, 2016, 16 pages.

Non-Final Office Action for U.S. Appl. No. 13/683,534, dated Oct. 19, 2015, 25 pages.

Final Office Action for U.S. Appl. No. 13/683,534, dated May 19, 2016, 20 pages.

Advisory Action and AFCP 2.0 Decision for U.S. Appl. No. 13/683,534, dated Sep. 7, 2016, 7 pages.

(56) References Cited

OTHER PUBLICATIONS

Non-final Office Action for U.S. Appl. No. 13/365,461, dated May 5, 2014, 9 pages.
Final Office Action for U.S. Appl. No. 13/365,461, dated Nov. 3, 2014, 13 pages.
Non-final Office Action for U.S. Appl. No. 13/365,461, dated May 22, 2015, 12 pages.
Final Office Action for U.S. Appl. No. 13/365,461, dated Sep. 25, 2015, 13 pages.
Notice of Allowance for U.S. Appl. No. 13/365,461, dated Mar. 25, 2016, 7 pages.
Notice of Allowance and Examiner-Initiated Interview Summary for U.S. Appl. No. 13/431,361, dated Apr. 14, 2014, 9 pages.
Examiner's Answer for U.S. Appl. No. 13/708,457, dated Nov. 3, 2016, 17 pages.
Non-Final Office Action for U.S. Appl. No. 13/683,534, dated Nov. 18, 2016, 18 pages.
Final Office Action for U.S. Appl. No. 13/683,534, dated Apr. 20, 2017, 21 pages.
Non-Final Office Action for U.S. Appl. No. 13/683,534, dated Feb. 2, 2018, 29 pages.

* cited by examiner

STAGED GRAPHITE FOAM HEAT EXCHANGERS

This application claims the benefit of U.S. Provisional Applicant Ser. No. 61/439,565, filed on Feb. 4, 2011, the entire contents of which are incorporated herein by reference.

FIELD

This disclosure relates to heat exchangers in general, and, more particularly, to staged heat exchangers configured as shell-and-tube heat exchangers, including evaporators, condensers and heating or cooling thermal transfer applications.

BACKGROUND

Heat exchangers are used in many different types of systems for transferring heat between fluids in single phase, binary or two-phase applications. An example of a commonly used heat exchanger is a shell-and-tube heat exchanger. Generally, a shell-and-tube heat exchanger includes multiple tubes placed between two tube sheets and encapsulated in a shell. A first fluid is passed through the tubes and a second fluid is passed through the shell such that it flows past the tubes separated from the first fluid. Heat energy is transferred between the first fluid and second fluid through the walls of the tubes.

A shell-and-tube heat exchanger is considered the primary heat exchanger in industrial heat transfer applications since they are economical to build and operate. However, shell-and-tube heat exchangers are not generally known for having high heat transfer efficiency.

SUMMARY

Shell-and-tube heat exchangers are described that utilize one or more foam heat transfer units engaged with the tubes to enhance the heat transfer between first and second fluids. The foam of the heat transfer units can be any thermally conductive foam material that enhances heat transfer, for example graphite foam. The shell-and-tube heat exchangers described herein are highly efficient, inexpensive to build, and corrosion resistant. The described heat exchangers can be used in a variety of applications, including but not limited to, low thermal driving force applications, power generation applications, and non-power generation applications such as refrigeration and cryogenics.

The heat exchanger will be described herein as being configured as an evaporator, although the heat exchanger concepts described herein can also be employed on a condenser, or for single phase cooling or heating thermal transfer applications.

In one embodiment, the heat exchanger employs foam material that is engaged with the tubes of the tube bundle to enhance heat exchange between a fluid flowing through the tubes and a second fluid within the shell. The foam material can be in the form of a foam heat transfer unit connected to a plurality of the tubes. The foam heat transfer unit can take on many different configurations to accomplish its heat transfer function.

The foam of the heat transfer units can be any thermally conductive foam material that enhances heat transfer, for example graphite foam or metal foam. In one embodiment, the heat transfer unit includes graphite foam. In other embodiments, the heat transfer consists essentially of, or consists of, graphite foam.

In another embodiment, the heat exchanger employs spraying of liquid to maximize the energy transfer through the use of large surface/volume ratio of the sprayed liquid. This maximized energy transfer from sprayed liquid is particularly beneficial in evaporator applications to increase efficiency, but could also be employed in condenser applications as well as cooling/heating thermal transfer applications.

In some embodiments, foam heat transfer units need not be used. Instead, higher efficiency is achieved by using spraying of liquid only. In these embodiments, the spraying can be coupled with helically twisted tubes surrounding a spray distribution tube. If desired, the spraying can be used in combination with foam heat transfer units to achieve even higher efficiency.

Baffles can also be utilized in the heat exchanger to increase the fluid path and residence time in the heat exchanger to further enhance efficiency.

The heat exchanger includes a shell having a longitudinal axis. The shell and the longitudinal axis thereof can be oriented horizontally, vertically, or at any angle therebetween. A tube bundle is disposed within the shell, with the tube bundle including a first plurality of tubes configured to convey a fluid, a first tube sheet and a second tube sheet. At least a portion of the first tubes are arranged parallel to the longitudinal axis. The first tubes can have any desired tube layout/configuration including, but not limited to, single pass and multi-pass.

Each of the tubes includes an outer surface, a first end joined to the first tube sheet in a manner to prevent fluid leakage between the first end and the first tube sheet and a second end joined to the second tube sheet in a manner to prevent fluid leakage between the second end and the second tube sheet.

One suitable method for connecting the tubes and the tube sheets is friction-stir-welding (FSW). The use of FSW is particularly beneficial in heat exchanger applications subject to corrosive service, since the FSW process eliminates seams, no dissimilar metals are used and, in the case of saltwater environments, no galvanic cell is created.

A first heat transfer unit is connected to and in thermal contact with the outer surfaces of the first plurality of tubes. The first heat transfer unit includes graphite foam. In addition, a first liquid distribution tube is disposed within the shell parallel to the longitudinal axis, with the liquid distribution tube being configured to spray a liquid onto the outer surfaces of the first plurality of tubes.

The heat exchange evaporator can have a plurality of the foam heat transfer units with a number of configurations. In one embodiment, the heat transfer units can be spaced from each other and configured to form stages along an axial direction of the plurality of the tubes. In another embodiment, the heat transfer units comprise foam bodies that are arranged into a helix. Examples of foam bodies include plate-shaped bodies, wedge-shaped bodies, triangular-shaped bodies, square-shaped bodies. Other shapes and configurations of foam heat transfer units can also be used. In addition, the tube bundle can contain multiple sets of tubes and heat transfer units, arranged in various patterns.

The liquid distribution tube can extend through the heat transfer unit(s) and/or can be partially or wholly surrounded by the first plurality of tubes. Multiple liquid distribution tubes can also be used, which can extend through the heat transfer unit(s). Each liquid distribution tube can also be wholly or partially surrounded by its own plurality of tubes. In addition, the liquid distribution tubes can be located in the shell vertically above, or on top of, the tube bundle.

In another embodiment, a heat transfer unit for use in a heat exchanger includes a body that consists essentially of foam material, such as graphite foam or metal foam. The body includes first and second major surfaces and a perimeter edge. A plurality of tube holes extend through the body from the first major surface to the second major surface, with the tube holes having central axes that are parallel to each other. Each tube hole is configured to connect to an outer surface of a heat exchange tube of the heat exchanger for establishing thermal contact between the foam material and the heat exchange tube. In addition, at least one fluid conducting hole extends through the body from the first major surface to the second major surface. The fluid conducting hole has a central axis that is parallel to the central axes of the tube holes.

The tubes of the heat exchangers described herein can be arranged in numerous patterns and pitches, including but not limited to, an equilateral triangular pattern defining a triangular pitch between tubes, a square pattern defining a square pitch between tubes, and a staggered square pattern defining a square or diamond pitch between tubes.

The heat exchangers described herein can also be configured to have any desired flow configuration, including but not limited to, cross-flow, counter-current flow, and co-current flow. Further, the shell, tubes, tube sheets, and other components of the described heat exchangers can be made of any materials suitable for the desired application of the heat exchanger including, but not limited to, metals such as aluminum, titanium, copper and bronze, steels such as high alloy stainless steels, and non-metals such as plastics, fiber-reinforced plastics, thermally enhanced polymers, and thermoplastics.

DRAWINGS

FIGS. 16A-F illustrate examples of patterns formed by different configurations of foam heat transfer units.

DETAILED DESCRIPTION

Figure 1:
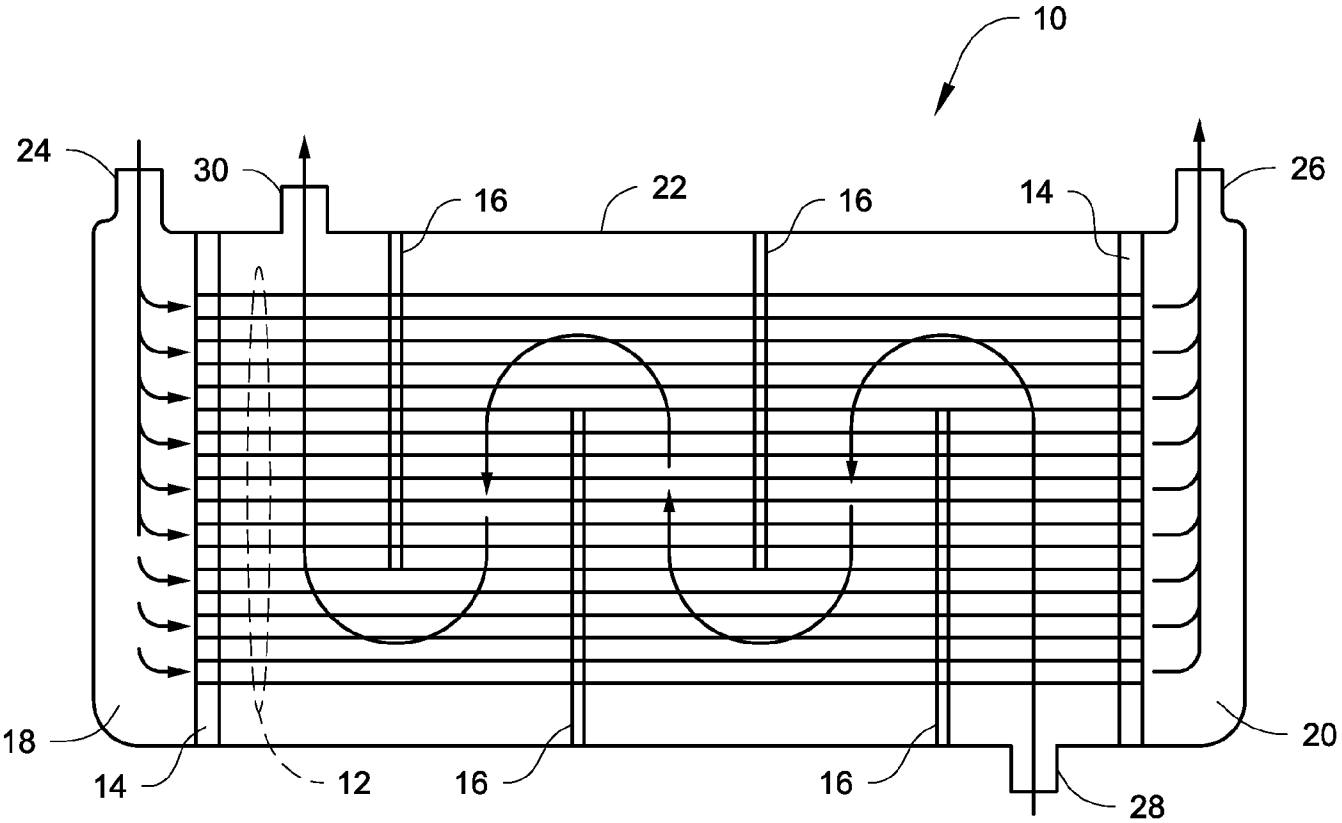
Fig. 1 (Prior Art)
FIG. 1 shows a conventional single-pass, counter-current flow shell-and-tube heat exchanger.

FIG. 1 shows a conventional shell-and-tube heat exchanger 10 that is configured to exchange heat between a first fluid and a second fluid in a single-pass, primarily counter-flow (the two fluids flow primarily in opposite directions) arrangement. The heat exchanger 10 has a tube bundle formed by tubes 12 and a tube sheet 14 at each end of the tubes, baffles 16, an input plenum 18 for a first fluid, an output plenum 20 for the first fluid, a shell 22, an inlet 24 to the input plenum for the first fluid, and an outlet 26 from the output plenum for the first fluid. In addition, the shell 22 includes an inlet 28 for a second fluid and an outlet 30 for the second fluid.

The first fluid and the second fluid are at different temperatures. For example, the first fluid can be at a higher temperature than the second fluid so that the second fluid is heated by the first fluid. The first fluid and the second fluid can be liquids, vapor, or one fluid can be a liquid while the other fluid can be a vapor.

During operation, the first fluid enters through the inlet 24 and is distributed by the manifold or plenum 18 to the tubes 12 whose ends are in communication with the plenum 18. The first fluid flows through the tubes 12 to the second end of the tubes and into the output plenum 20 and then through the outlet 26. At the same time, the second fluid is introduced into the shell 22 through the inlet 28. The second fluid flows around and past the tubes 12 in contact with the outer surfaces thereof, exchanging heat with the first fluid flowing through the tubes 12. The baffles 16 help increase the flow path length of the second fluid, thereby increasing the interaction and residence time between the second fluid in the shell-side and the walls of tubes. The second fluid ultimately exits through the outlet 30.

In the case of a heat exchange evaporator, the first fluid can be a liquid at a temperature higher than the temperature of the second fluid, while the second fluid enters the inlet 28 as a liquid but is vaporized upon contact with the tubes 12. The vapor then exits the shell through the outlet 30. However, in appropriate circumstances understood by persons of ordinary skill in the art, the concepts described herein can be applied to heat exchanger condensers and heating or cooling thermal transfer applications.

For sake of convenience, the heat exchanger examples herein will be described as heat exchange evaporators, it being understood that the described technology has applications in heat exchangers in general, including evaporators, condensers and heating or cooling thermal transfer applications. Also, the examples herein are shown as single-pass shell-and-tube heat exchangers. However, the described technology has applications in heat exchangers that have many other configurations, including staged heat exchangers in general, single or multi-pass systems, counter-current flow, cross-flow (the two fluids flow primarily generally perpendicular to one another), co-current flow (the fluids primarily flow in the same directions), or the two fluids flow at flow at any angle therebetween. Further, the heat exchangers can be oriented horizontally, vertically, or any angle therebetween.

Figure 2:
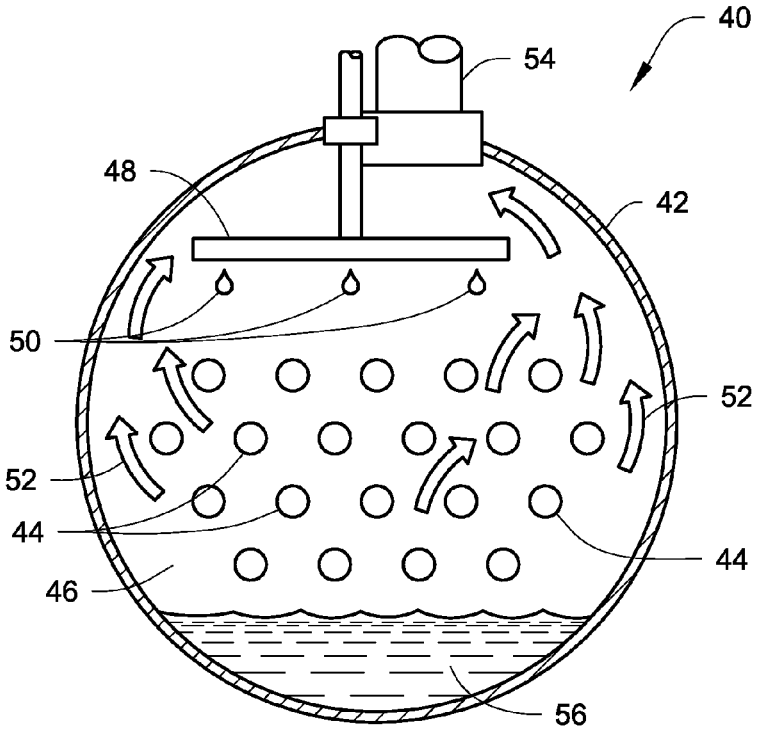
Fig. 2 (Prior Art)
FIG. 2 shows a cross sectional view of a conventional shell-and-tube heat exchange evaporator.

FIG. 2 is a cross-sectional view of a conventional shell-and-tube heat exchanger 40 configured as an evaporator disposed in a horizontal orientation. The heat exchanger 40 includes a shell 42 and a tube bundle formed by a plurality of tubes 44 secured at each end thereof to tube sheets (not shown) disposed at ends of the heat exchanger 40. The shell 42 and the tube sheets collectively define a chamber 46. The tubes 44 are fluidically isolated from the chamber 46 so that a fluid flowing through the tubes does not mix with a second fluid within the chamber 46. However, the tubes 44 transfer thermal energy between the fluid flowing therethrough and the fluid in the chamber 46.

A liquid distributor 48 is disposed inside the chamber 46 and is configured to spray or drop a liquid 50 in the chamber 46. The liquid distributor 48 is disposed above the tubes 44 and sprays or drops the liquid 48 down onto the tubes 44. The liquid flowing through the tubes 44 is at a higher temperature than the liquid 50. As a result, when the liquid 50 comes into contact with the outside surfaces of the tubes 44, the liquid 50 absorbs heat energy from the heat conducted through the tubes 44 from the flowing fluid inside the tubes. The liquid 50 is then vaporized 52 and the vapor 52 rises in the chamber 46 and exits the chamber via a vapor outlet 54. Any of the liquid 50 that does not vaporize collects at the bottom of the chamber 46 in a pool 56.

Further examples of shell-and-tube heat exchanger falling film evaporators are disclosed in U.S. Pat. Nos. 6,167,713 and 6,516,627.

Figure 3:
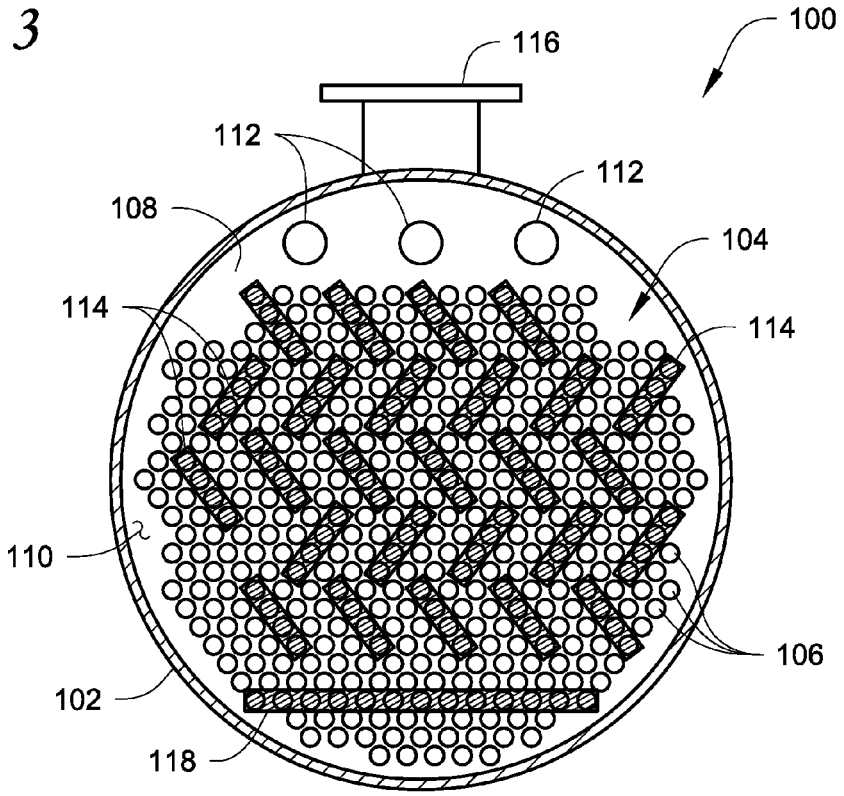
FIG. 3 is a cross-sectional view of an improved horizontal shell-and-tube heat exchanger that employs an improved tube bundle with foam heat transfer units.

With reference to FIG. 3, a cross-sectional view of an improved shell-and-tube heat exchange evaporator 100 is illustrated. In this example, the evaporator 100 is arranged horizontally. The evaporator 100 includes a shell 102 having a longitudinal axis extending into and out of the figure. A tube bundle 104 is disposed in the shell, with the tube bundle including a plurality of heat exchange tubes 106 configured to convey a first fluid, a first tube sheet 108 and a second tube sheet (not shown). The shell 102 and the tube sheets define an interior chamber 110 in which the tubes 106 are disposed.

The tubes 106 are arranged parallel to the longitudinal axis of the shell so the tubes are in a horizontal orientation. As will be explained in more detail below with respect to FIGS. 3-4, each of the tubes 106 includes an outer surface, a first end joined to the first tube sheet 108 in a manner to prevent fluid leakage between the first end and the first tube sheet and a second end joined to the second tube sheet in a manner to prevent fluid leakage between the second end and the second tube sheet. As discussed further below, the tubes and tube sheets can be joined by any suitable joining technique, such as friction stir welding (FSW).

The tubes and the tube sheets are preferably made of same material, such as, for example, aluminum, aluminum alloy, or marine-grade aluminum alloy. Aluminum and most of its alloys, as well as high alloy stainless steels and titanium, are amenable to the use of the FSW joining technique. The tubes and tube sheets can also be made from other materials such as metals including, but not limited to, high alloy stainless steels, titanium, copper, and bronze, and non-metal materials including, but not limited to, thermally enhanced polymers or thermoset plastics.

Other joining techniques can be used to secure the tubes and the tube sheets, such as expansion, press-fit, brazing, bonding, and welding (such as fusion welding and lap welding), depending upon the application and needs of the heat exchanger and the user.

A plurality of horizontal liquid distribution tubes 112 are disposed within the chamber 110 parallel to the longitudinal axis and parallel to the tubes 106. In this example, the liquid distribution tubes 112 are disposed above the tubes 106 and are configured to spray a liquid within the chamber 110 of the shell 102. Because the tubes 112 are disposed above the tubes 106, liquid sprayed from the tubes 112 falls or cascades downward under gravity onto the outer surfaces of the tubes 106. The tubes 112 can be connected at one or both ends thereof to the tube sheets in the same manner as the tubes 106. In another embodiment discussed further below, one or more flow distribution tubes can be disposed within the tubes of the tube bundle, in addition to or in place of, the tubes 112.

To enhance heat transfer, a plurality of groups of the tubes 106 are contacted by foam heat transfer units 114. In this example, the heat transfer units 114 comprise rectangular blocks of foam that are in thermal contact with, directly or indirectly, the outside surfaces of a plurality of the tubes 106. Each heat transfer unit 114 would extend some or all of the axial length of the tubes 106 to which they are connected to. The groups of each of the heat transfer units 114 and the tubes 106 are arranged into a staggered diagonal baffle arrangement which is useful in applications where the second fluid flows in a cross-flow direction relative to the flow of the first fluid through the tubes. However, other heat transfer unit configurations and arrangements, as well as other flow patterns, are possible. For example, the foam blocks can be between the tubes in a triangular pattern (like FIG. 10) or a square pattern (like FIGS. 9A and 9B). The foam configurations shown in FIGS. 16A-F can also be used.

The heat transfer units 114 (as well as the heat transfer units described below) includes, or consists essentially of, or consists entirely of, a foam material such as graphite foam or metal foam. The term foam material is used herein to describe a material having closed cells, open cells, coarse porous reticulated structure, and/or combinations thereof. Examples of metal foam include, but are not limited to, aluminum foam, titanium foam, bronze foam or copper foam. In an embodiment, the foam material does not include metal such as aluminum, titanium, bronze or copper.

In one embodiment, the foam material is preferably graphite foam having an open porous structure. Graphite foam is advantageous because graphite foam has high thermal conductivity, a mass that is significantly less than metal foam materials, and have advantageous physical properties, such as being able to absorb vibrations (e.g. sound). Graphite foam can be configured in a wide range of geometries based on application needs and/or heat transfer requirements. Graphite foam can be used in exemplary applications such as power electronics cooling, transpiration, evaporative cooling, radiators, space radiators, EMI shielding, thermal and acoustic signature management, and battery cooling.

In use, the first fluid flowing through the tubes 106 is at a first temperature higher than the temperature of the second fluid that is sprayed from the tubes 112. The first fluid can enter and exit the tubes 106 in the manner illustrated in FIG. 1 or in any other suitable manner. At the same time, the second fluid is introduced into the tubes 112 and is sprayed in the chamber 110. The sprayed second fluid cascades downward over the outer surfaces of the tubes and over the foam heat transfer units 114 in a cross-flow pattern. Because the first fluid is at a higher temperature than the second fluid, heat is transferred from the first fluid into the second fluid through the walls of the tubes 106 and the foam heat transfer units 114. Preferably, the temperature of the first fluid is sufficient to cause the second fluid contacting the outer surfaces of the tubes and/or the surfaces of the heat transfer units 114 to thin film boil and evaporate the second fluid into a vapor. The vapor then rises up in the chamber 110 and exits the chamber via a vapor outlet 116.

In other embodiments, the heat exchanger can be configured as a condenser in which one of the fluids is condensed from a vapor into a liquid via heat exchange. Also, the heat exchanger can be configured for thermal transfer applications in which a liquid that is sprayed from the tubes 112 exchanges heat with the liquid in the tubes 106, with the liquids remaining in liquid form. In such a single-phase liquid-liquid embodiment, a liquid outlet would be provided at the bottom of the shell instead of at the top of the shell for vapor.

The staggered diagonal baffle arrangement of the tubes 106 and heat transfer unit 114 groups helps to ensure maximum contact between the cascading second fluid and the outer surfaces of the tubes 106 and the surfaces of the heat transfer units 114 to maximize vaporization. The foam of the heat transfer units 114 helps to increase the heat transfer efficiency from the first fluid to the second fluid. However, the arrangement of the tubes 106 and heat transfer unit 114 groups in FIG. 3 is exemplary only. Other arrangements and groupings can be used as discussed below in, for example, FIGS. 16A-F. Also, the foam heat transfer units 114 can be other than rectangular blocks, such as triangular or square blocks of formed and radiused to fit between the tubes of the tube bundle as discussed below in FIGS. 9A, 9B, and 10. Any arrangement or configuration of foam material described herein that is in contact with the outer surfaces of the tubes 106 to facilitate the transfer of heat energy from the first fluid into the second fluid can be used.

FIG. 3 also illustrates a foam heat transfer unit 118 adjacent the bottom of the chamber 110 that extends across the entire width of the chamber at that location. Additional similar heat transfer units 118 would be axially spaced from one another along the axial length of the chamber 110, or alternatively the foam heat transfer unit 118 could be a single body that extends across the entire width and axial length of the chamber with openings provided in the body to allow the second fluid to pass through the heat transfer unit 118. Any of the second fluid that makes it down to the heat transfer unit(s) 118 without vaporizing impinges on the heat transfer unit(s) 118 and/or any remaining tubes 106 to ensure maximum vaporization of the second fluid.

Figure 4:
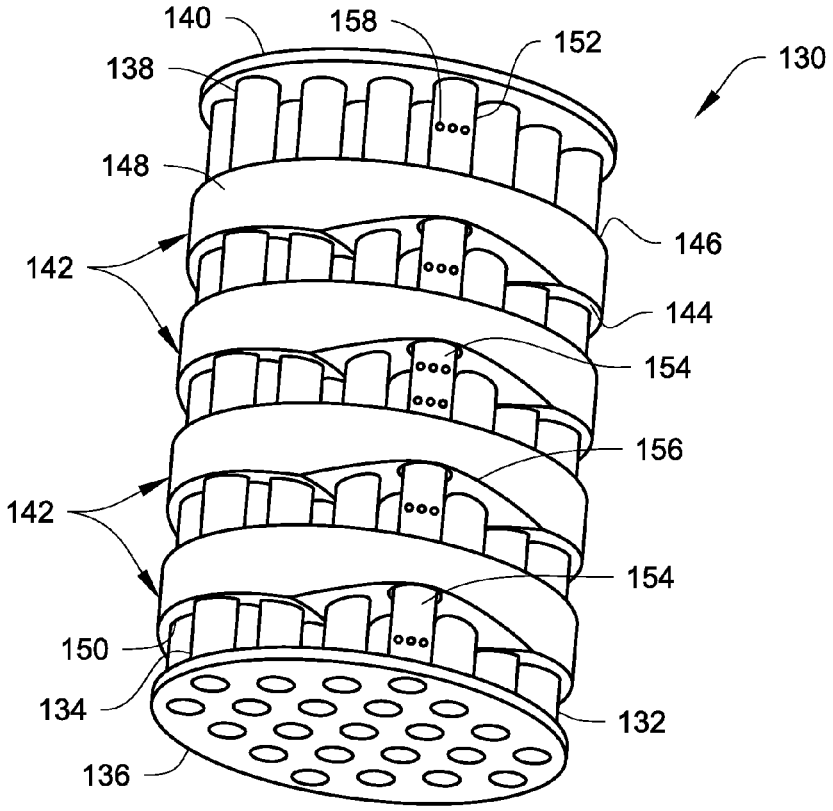
FIG. 4 is a perspective view of an embodiment of an improved tube bundle for a vertical shell-and-tube heat exchanger described herein.
Figure 5:
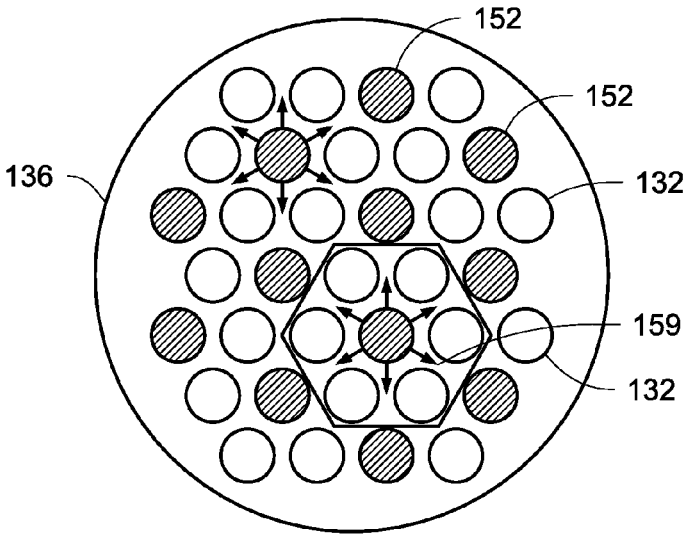
FIG. 5 is a cross-sectional view through the tube bundle shown in FIG. 4.

With reference to FIGS. 4-5, another example of an improved tube bundle 130 is illustrated that can be used in a shell-and-tube heat exchange evaporator. However, unlike FIG. 3, the tube bundle 130 is configured to be in a vertical orientation, disposed within a shell where the shell and the longitudinal axis thereof are arranged generally vertically.

The tube bundle 130 extends substantially the length of the shell and includes a plurality of hollow heat exchange tubes 132 for conveying the first fluid through the heat exchanger. The tubes 132 are arranged parallel to the longitudinal axis when mounted in the evaporator. The tubes 132 are fixed at a first end 134 to a first tube sheet 136 and fixed at a second end 138 to a second tube sheet 140. As would be understood by a person of ordinary skill in the art, the tube sheets 136, 140 are sized to fit within the ends of the shell with a relatively close fit between the outer surfaces of the tube sheets and the inner surface of the shell. When the tube bundle 130 is installed inside the shell, the tube sheets of the tube bundle and the shell collectively define an interior chamber that contains the tubes 132 of the tube bundle.

As shown in FIGS. 4-5, the ends of the tubes 132 penetrate through the tube sheets 136, 140 via holes in the tube sheets so that inlets/outlets of the tubes are provided on the sides of the tube sheets facing away from the interior chamber of the shell. The ends of the tubes 132 may be attached to the tube sheets in any manner to prevent fluid leakage between the tubes 132 and the holes through the tube sheets. In example, the ends of the tubes are attached to the tube sheets by friction stir welding (FSW).

FSW is a known method for joining elements of the same material. Immense friction is provided to the elements such that the immediate vicinity of the joining area is heated to temperatures below the melting point. This softens the adjoining sections, but because the material remains in a solid state, the original material properties are retained. Movement or stirring along the weld line forces the softened material from the elements towards the trailing edge, causing the adjacent regions to fuse, thereby forming a weld. FSW reduces or eliminates galvanic corrosion due to contact between dissimilar metals at end joints. Furthermore, the resultant weld retains the material properties of the material of the joined sections. Further information on FSW is disclosed in U.S. Patent Application Publication Number 2009/0308582, titled Heat Exchanger, filed on Jun. 15, 2009, which is incorporated herein by reference.

The tubes and the tube sheets are preferably made of the same material, such as, for example, aluminum, aluminum alloy, or marine-grade aluminum alloy. Aluminum and most of its alloys, as well as high alloy stainless steels and titanium, are amenable to the use of the FSW joining technique. The tubes and tube sheets can also be made from other materials such as metals including, but not limited to, high alloy stainless steels, titanium, copper, and bronze, and non-metal materials including, but not limited to, thermally enhanced polymers or thermoset plastics.

Other joining techniques can be used to secure the tubes and the tube sheets, such as expansion, press-fit, brazing, bonding, and welding (such as fusion welding and lap welding), depending upon the application and needs of the heat exchanger and the user.

In the example illustrated in FIGS. 4-5 (as well FIG. 3), the tubes 132 are substantially round when viewed in cross-section or from either end, and are substantially linear from the end 134 to the end 138. However, the shape of the tubes, when viewed in cross-section, can be square or rectangular, triangular, oval shaped, or any other shape, and combinations thereof. In addition, the tubes need not be linear from end to end, but can instead be curved, helical, and other shapes deviating from linear. In the illustrated example, the tubes 132 are configured for single pass flow, however the tubes 132 can be configured to provide multi-pass flow. In addition, it is to be realized that a smaller or larger number of tubes can be provided in the tube bundle.

A plurality of foam heat transfer units 142 are connected to and in thermal contact with the outer surfaces of the first plurality of tubes. As with the heat transfer units 114, the heat transfer units 142 include, consist essentially of, or consist entirely of a foam material, for example graphite foam or metal foam. The heat transfer units 142 are axially spaced from one another along the tube bundle.

Each of the heat transfer units 142 includes a body that has first and second major surfaces 144, 146 and a perimeter edge 148, with the thickness of the body defined between the major surfaces 144, 146. The perimeter edge 148 of each heat transfer unit 142 is preferably radiused or otherwise shaped to match the inside shape of the heat-exchanger shell, and are sized such that the perimeter edge 148 is positioned close to or in actual engagement with the interior surface of the shell to minimize or prevent flow of the second fluid between the perimeter edge 148 of the heat transfer units 142 and the interior surface of the shell.

In an embodiment, the heat transfer units 142 can be strengthened by the use of solid or perforated plates, made from a thermally conductive material such as aluminum, affixed to the heat transfer units 142 by suitable techniques, for example by bonding using an adhesive or by brazing. The plates can be used to assist in the assembly of the tube bundle and the heat exchanger, and the spacing of the plates and the amount of the foam will help maximize strength and minimize the pressure drop on the shell-side flow.

A plurality of tube openings 150 such as holes or cut-outs extend through the body from the first major surface to the second major surface, with the tube openings having central axes that are parallel to each other and parallel to the longitudinal axis of the shell. The tubes 132 extend through the tube openings 150 with a relatively tight fit to ensure that the body connects to the outer surfaces of the tubes for establishing direct or indirect thermal contact between the foam material and the heat exchange tubes 132. The tubes 132 can be connected to the heat transfer units 142 by any means, including but not limited to a frictional engagement, bonding with an adhesive, and/or other means, including combinations thereof.

If adhesive bonding is used, the adhesive can be thermally conductive. The thermal conductivity of the adhesive can be increased by incorporating ligaments of highly conductive graphite foam, with the ligaments in contact with the surfaces heat transfer unit(s) and the tubes, and the adhesive forming a matrix around the ligaments to keep the ligaments in intimate contact with the tubes and heat transfer units. The ligaments will also enhance bonding strength by increasing resistance to shear, peel and tensile loads.

The tube bundle 130 also includes one or more liquid distribution tubes 152 each of which is configured to spray a second liquid within the shell. In the illustrated embodiment, a plurality of the tubes 152 are utilized, spread within the tube bundle 130. However, a single tube 152 could be used if desired. The ends of the tubes 152 are fixed to the tube sheets 136, 140, with inlet ends of the tubes 152 penetrating the tube sheet 136 via holes in the tube sheet so that inlets of the tubes 152 are provided on the side of the tube sheet 136 facing away from the interior chamber of the shell. The inlet ends of the tubes 152 may be attached to the tube sheet in any manner to prevent fluid leakage between the inlet ends of the tubes 152 and the holes through the tube sheet. For example, the inlet ends of the tubes 152 can be attached to the tube sheet using FSW. The opposite ends of the tubes 152 can also be fixed to the tube sheet 140 by FSW or other means. However, the opposite ends are closed ends so that all of the second fluid that enters the tubes 152 is sprayed out.

The second fluid can be introduced into the tubes 152 in any suitable manner to prevent mixing with the first fluid that is introduced into the tubes 132. For example, a plurality of dedicated flow lines for the second fluid can be connected to the inlet ends of the tubes 152.

The tubes 152 extend through fluid conducting openings 154 such as holes or cut-outs that extend through the body from the first major surface to the second major surface. The fluid conducting openings 154 have central axes that are parallel to the central axes of the tube openings 150. The fluid conducting openings are sized slightly larger than the size of the tubes 152 to permit fluid communication between opposite sides of the heat transfer units 142 via the openings 154. To facilitate fluid flow through the openings 154 from one side of the heat transfer units to the other, a funnel-shaped portion 156 generally surrounds at least one of the openings 154 on at least one of the major surfaces 144, 146. The funnel-shaped portion 156 helps to direct flow of the second fluid and/or vapor into the opening 154. The term "funnel-shape" is used herein to describe a shape that includes, but is not limited to, concave, a conical shape with a wider and a narrower opening at each of the ends, and/or any other shapes that can aid in flow of vapor through the hole 362 for conveying the second fluid and/or vapor.

The illustrated embodiment shows the funnel-shaped portion 156 on the first major surface 144 of each heat transfer unit 142. However, other configurations of the funnel-shaped portions are possible. For example, a corresponding funnel-shaped portion can be provided on the second major surface 146 opposite the funnel-shaped portion 156 on the first major surface. Alternatively, the funnel-shaped portion can be provided just on the second major surface. A funnel-shaped portion can be provided around each of the openings 154. Other arrangements and configurations are possible including any configuration that facilitates fluid flow through the openings 154.

The heat transfer units 142 separate the tube bundle into stages along an axial length direction of the tubes 132, with the fluid conducting openings 154 facilitating axial flow of the second fluid between the stages.

As shown in FIG. 4, each of the tubes 152 includes a plurality of spray holes 158 formed therein through which the second fluid is sprayed 159 outward. Any number or configuration of spray holes 158 can be used. Preferably, the spray holes 158 of at least some of the tubes 152 are arranged so that the second fluid sprays 159 in substantially 360 degrees in all directions. In this regard, and with reference to FIG. 5, some of the tubes 132 are disposed so as to substantially surround the tube 152 in for example a hexagonal pattern shown by the hexagon in FIG. 5. Other tube layouts having other tube pitch arrangements are possible. For example, as shown in FIG. 10, an equilateral triangular pitch (i.e. the space between the tubes is generally an equilateral triangle), or a square pitch shown in FIG. 9A, or a staggered square pitch shown in FIG. 9B, can be used.

As shown by the hexagonal line in FIG. 5, the tubes 132 and the tubes 152 are arranged so that, for a plurality of the spray tubes 152, six of the tubes 132 surround each of the spray tubes 152. When the spray tubes 152 spray the second fluid in all directions as indicated by the arrows 159, the second fluid impinges on the outer surfaces of the tubes 132 and on the surfaces of the foam heat transfer units 142.

In use, a first fluid is introduced into the tubes 132 at a first temperature higher than the temperature of a second fluid that is introduced into and sprayed from the tubes 152. The second fluid is sprayed from the tubes 152 and onto the outer surfaces of the tubes 132 and onto the foam heat transfer units 142. Because the first fluid is at a higher temperature than the second fluid, heat is transferred from the first fluid into the second fluid through the walls of the tubes 132 and the foam heat transfer units 142. The second fluid can flow between the stages through the openings 154. Preferably, the temperature of the first fluid is sufficient to cause the second fluid contacting the outer surfaces of the tubes and/or the surfaces of the heat transfer units to thin film boil and evaporate the second fluid into a vapor. The vapor then rises up in the chamber and exits the chamber via a vapor outlet (not shown in FIG. 4). In the case of a vertical shell, with the tube bundle 130 arranged vertically, the vapor outlet port can be adjacent the top of the shell.

Figure 6:
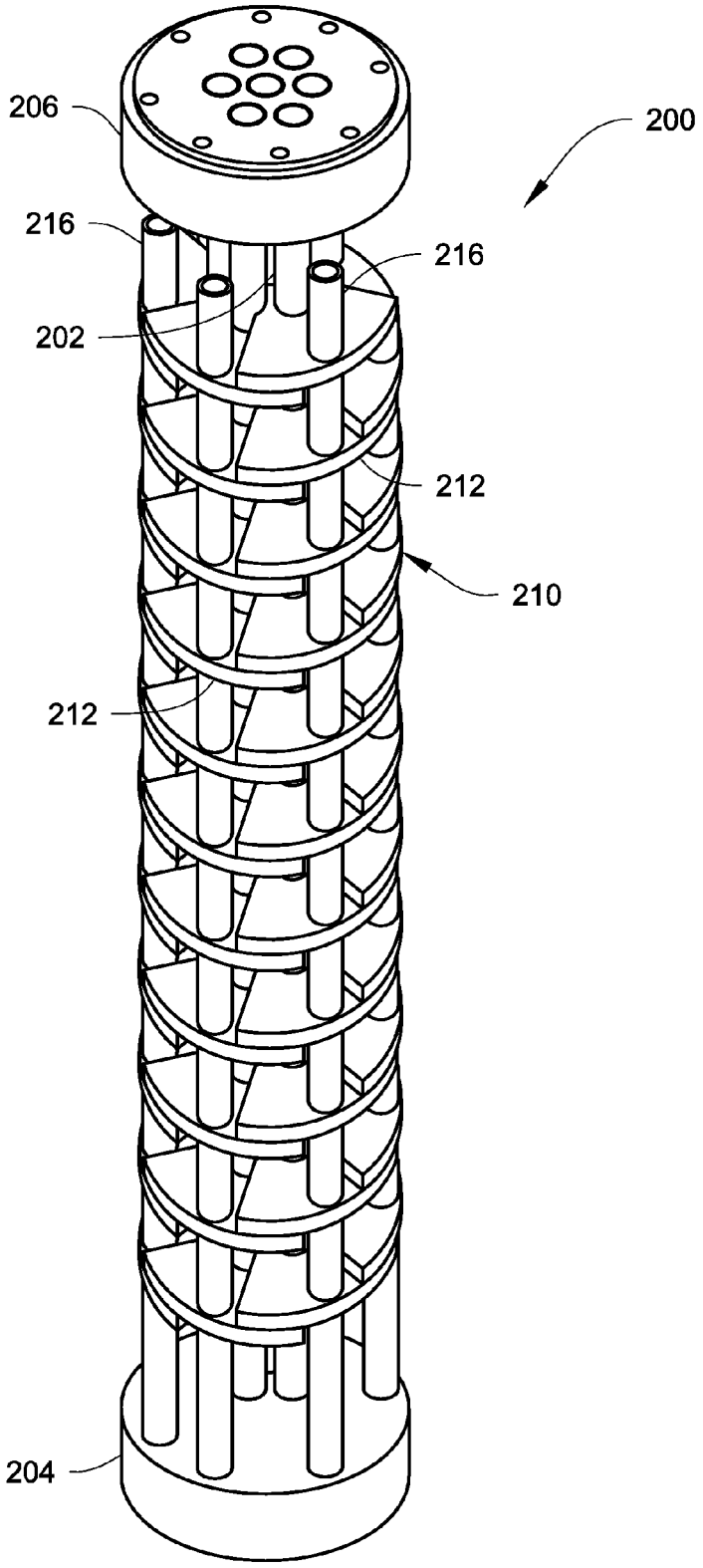
FIG. 6 is a perspective view of another embodiment of an improved tube bundle for a horizontal or vertical shell-and-tube heat exchanger described herein.
Figure 7:
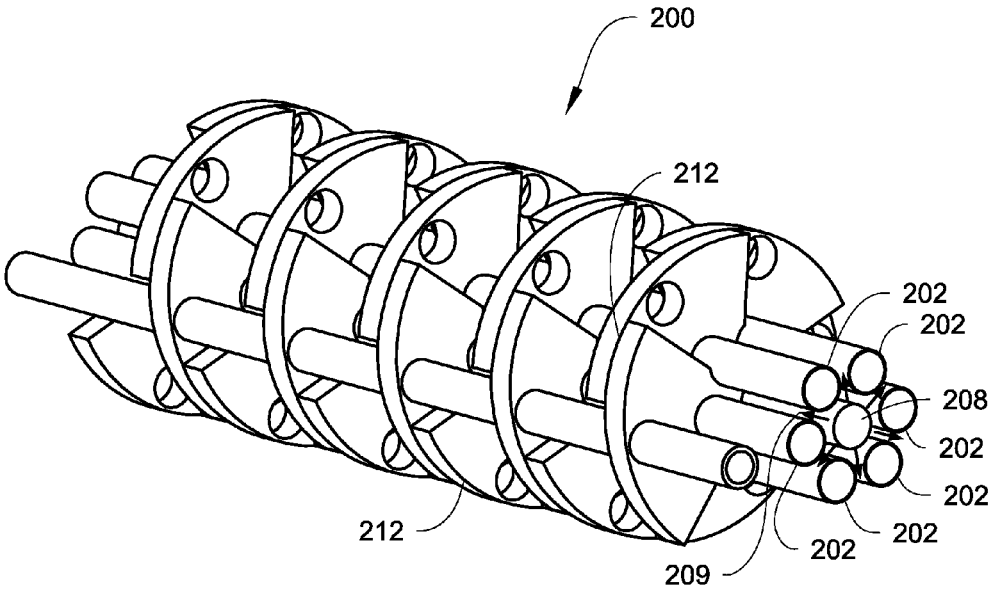
FIG. 7 is a partial, isometric view of the tube bundle of FIG. 6.
Figure 8:
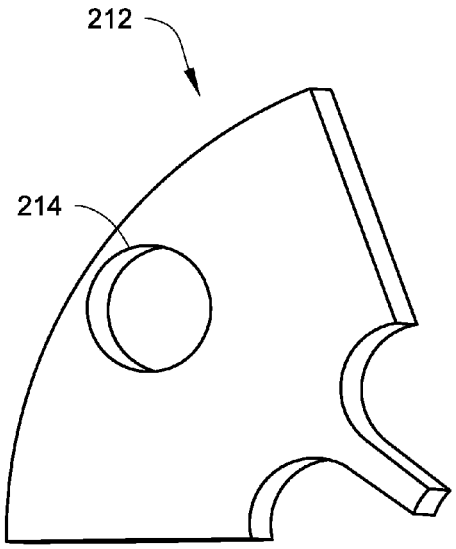
FIG. 8 illustrates a foam heat transfer unit used with the tube bundle of FIGS. 6-7.

Turning to FIGS. 6-8, an improved tube bundle 200 for a shell-and-tube heat exchange evaporator is illustrated. The tube bundle 200 can be arranged horizontally, vertically or any angle therebetween in a corresponding horizontal, vertical, or other angle shell-and-tube heat exchanger.

The tube bundle 200 includes a plurality of hollow tubes 202 for conveying the first fluid through the heat exchanger disposed between tube sheets 204, 206. As shown in FIG. 6, the ends of the tubes 202 penetrate through the tube sheets 204, 206 via holes in the tube sheets so that inlets/outlets of the tubes are provided on the sides of the tube sheets facing away from the interior chamber of the shell. The ends of the tubes 202 may be attached to the tube sheets in any manner to prevent fluid leakage between the tubes and the holes through the tube sheets, such as by FSW.

The tubes 202 surround a liquid distribution tube 208 that is disposed centrally in the tube bundle. As shown in FIG. 7, the tube 208 is configured to spray 209 the second fluid substantially 360 degrees in all directions in order to impinge on the tubes 202. The tube 208 can be connected to the tube sheets in the same or similar manner as the tubes 152 in FIG. 4.

The tube bundle 200 also includes a baffle assembly 210 integrated therewith. In the illustrated embodiment, the baffle assembly 210 is formed by a plurality of discrete (i.e. separate) foam heat transfer units 212 that are connected to each other so that the baffle assembly 210 has a substantially helix-shape that extends along the majority of the length of the tube bundle around the longitudinal axis of the tube bundle. More preferably, the helix-shaped baffle assembly formed by the heat transfer units 212 extends substantially the entire axial length of the tube bundle.

In an embodiment, the heat transfer units 212 can be strengthened by the use of solid or perforated plates, made from a thermally conductive material such as aluminum, affixed to the heat transfer units. The plates can be affixed to the units 212 in a periodic pattern along the helix, or they can be affixed to the units in any arrangement one finds provides a suitable strengthening function. The plates can be used to assist in the assembly of the tube bundle and the heat exchanger, and can assist with minimizing the pressure drop on the shell-side flow.

The baffle assembly helps to increase the interaction time between the second fluid in the interior chamber of the shell and the walls of the tubes 202 while minimizing pressure drop in the system. Referring to FIG. 8 together with FIGS. 6-7, each heat transfer unit 212 comprises a generally wedge-shaped, planar body having a generally triangular or pie-shape. The units 212 include, consist essentially, or consist entirely of a foam material such as graphite foam or metal foam. A support rod opening 214 such as a hole or a cut-out extends through the body for receipt of a support rod 216 which is part of the tube bundle.

FIGS. 6 and 7 show the heat transfer units 212 mounted in position on the tube bundle 200. When mounted on the tube bundle, the heat transfer units 212 are connected to and in thermal contact with the outer surfaces of the plurality of tubes 202.

Further information on the heat transfer units 212 and a tube bundle containing the heat transfer units is disclosed in U.S. Patent Application Ser. No. 61/439,564, filed on Feb. 4, 2011 and titled Shell-and-Tube Heat Exchangers With Foam Heat Transfer Units, the entire contents of which are incorporated by reference herein.

As indicated above, the first fluid is at a higher temperature than the second fluid, in which case heat is transferred from the first fluid to the second fluid via the tubes and the heat transfer units, with the temperature difference being sufficient to cause the second fluid to vaporize. A vapor port would be provided adjacent the top of the heat exchanger through which vapor would exit the shell. Alternatively, the temperature difference can be such that the second fluid simply absorbs heat from the first fluid without vaporizing in which case a liquid outlet port would be provided adjacent the bottom of the heat exchanger. Alternatively, in appropriate circumstances, the second fluid can be at a higher temperature than the first fluid, in which case heat is transferred from the second fluid to the first fluid via the tubes and the heat transfer units and the second fluid is cooled.

Heat exchange efficiency can also be increased with other configurations of foam heat exchange units, either in combination with or separate from the above described heat exchange units. For example, foam heat exchange units can be shaped to fit in the pitch space between the tubes of the tube bundle. In addition, the liquid distribution tubes and foam heat exchange units can be used together or separately from one another.

For example, FIG. 10 shows a tube bundle that has a plurality of tubes 250 arranged with an equilateral triangular pitch (i.e. the space between the tubes is generally an equilateral triangle). FIG. 10 shows the tube bundle without a liquid distribution tube that sprays liquid. However, a plurality of foam heat transfer units 252 are shaped to fit in the pitch spaces between the tubes 250 and have surfaces that are in thermal contact with the tubes. Each of the heat transfer units 252 comprises a generally triangular body, that can be radiused to the curvature of the tubes, with a generally triangular cross-section, and with the three surfaces of the triangular body in thermal contact with, directly or indirectly, three separate tubes 250.

Figure 9A:
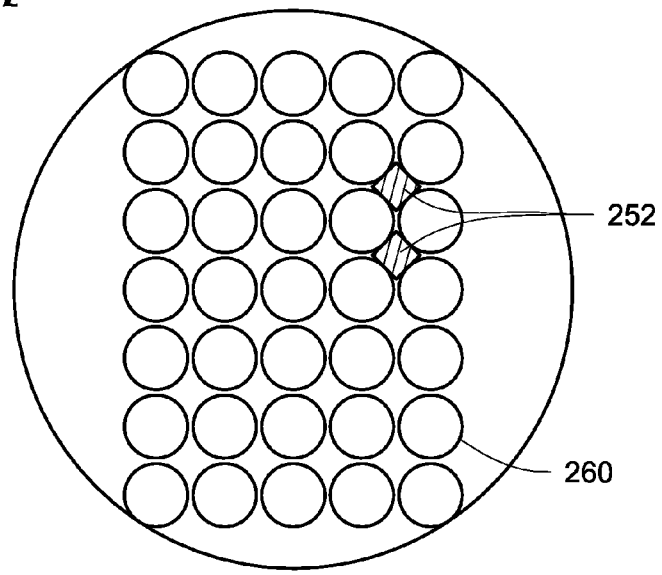
FIGS. 9A and 9B are cross-sectional end views of tube bundles having a square and staggered square pitch, respectively.
Figure 9B:
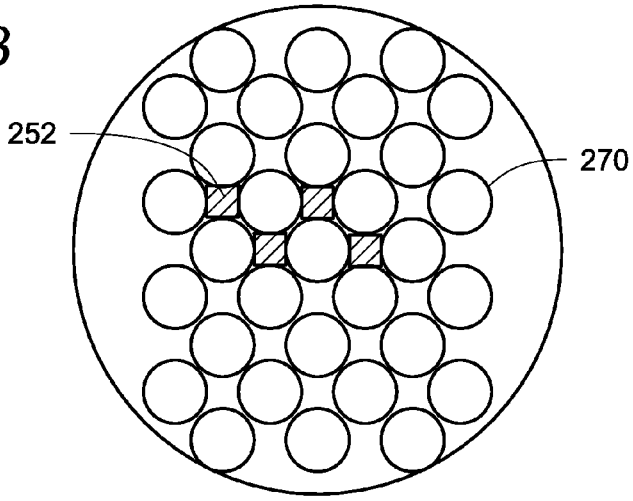
Figure 10:
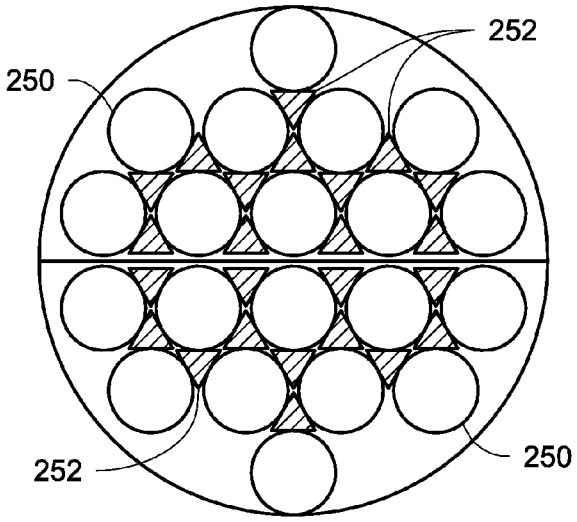
FIG. 10 is a cross-sectional end view of a tube bundle having an equilateral pitch illustrating triangular foam heat transfer units in the pitch spaces between the tubes.

FIG. 9A shows tubes 260 of a tube bundle arranged with a square pitch, while FIG. 9B shows tubes 270 of a tube bundle arranged with a staggered square pitch. In each of FIGS. 9A and 9B, rectangular or square blocks of foam heat transfer units 252 are disposed in the pitch spaces between the tubes 260, 270.

The heat transfer units in FIGS. 9A, 9B and 10 may be arranged as required for heat transfer efficiency and/or providing directional flow of the fluid outside the tubes. For example, the heat transfer units can be arranged in any configuration to mimic a helix, multiple helix, offset baffle, offset blocks, or other patterns as shown in FIGS. 16A-F.

Figure 11:
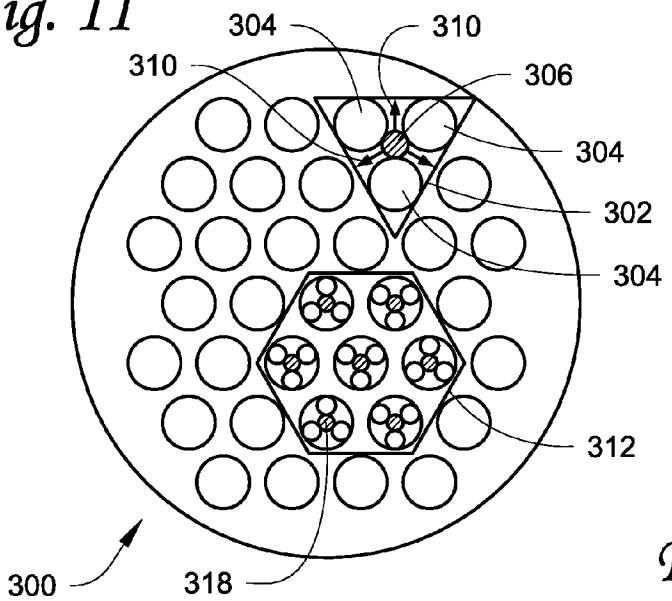
FIG. 11 is a cross-sectional view of another embodiment of the use of liquid distribution tubes.
Figure 12:
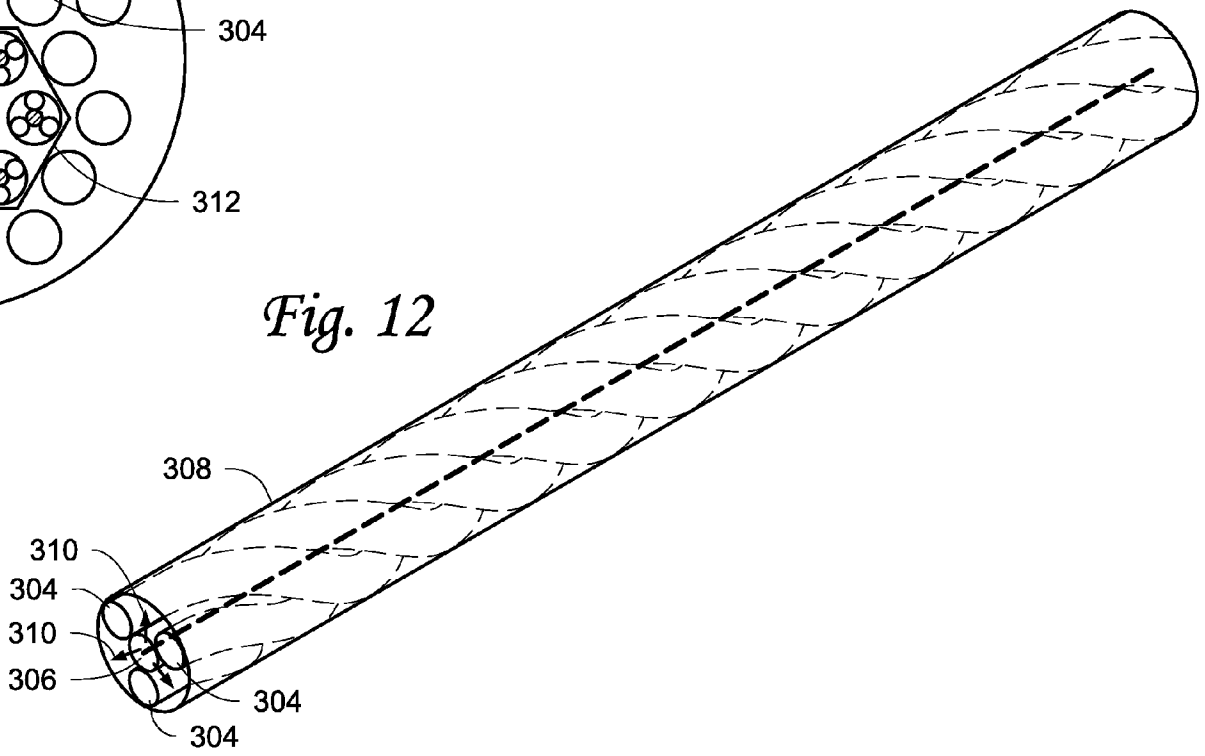
FIG. 12 illustrates details of the portion within the triangle in FIG. 11.
Figure 13:
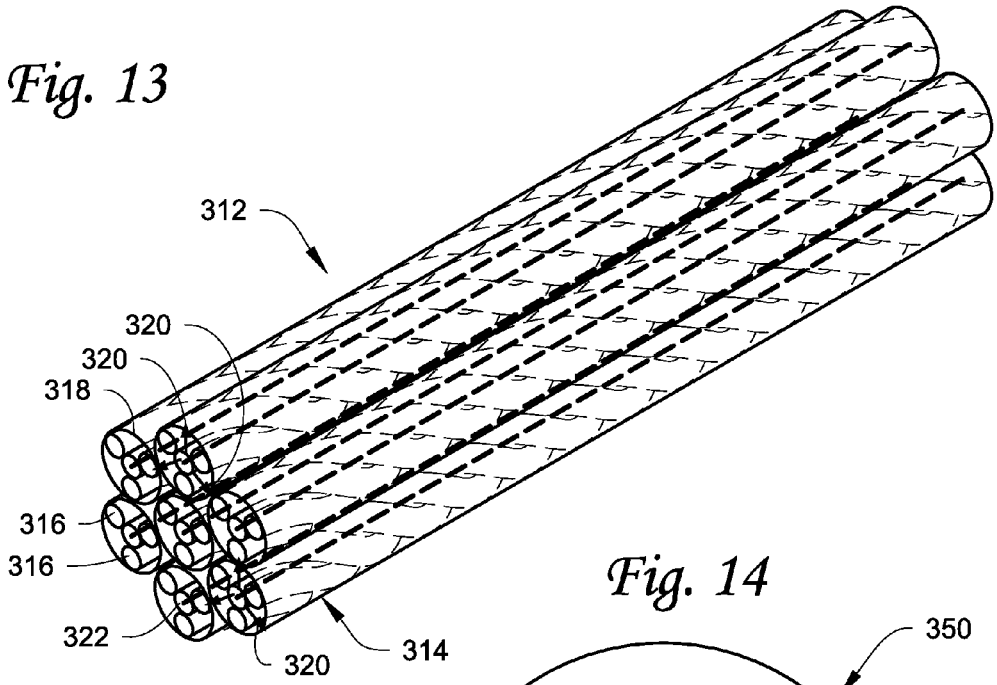
FIG. 13 illustrates details of the portion within the hexagon in FIG. 11.

With reference to FIGS. 11-13, an embodiment of a tube bundle 300 that uses a liquid distribution tube is illustrated. This embodiment can be used in combination with or separate from the use of foam heat transfer units. The tube bundle 300 employs metal tubes that are twisted helically around a metal liquid distribution tube along the length of the liquid distribution tube. The helical arrangement of tubes enhances heat flow between the fluid flowing in the tubes and the fluid flowing in the shell outside of the tubes, by breaking up boundary layers inside and/or outside the tubes and combining axial and radial flow of the fluid along and around the outer surface of the tubes. In addition, the use of a baffle can be eliminated if desired. Further, the tubes could be twisted about their own axes as well.

FIG. 11 illustrates two different exemplary implementations of the twisted or helical tube concept. The triangle 302 in FIG. 11 illustrates three tubes 304 helically twisted about a central liquid distribution tube 306. This is illustrated more fully in FIG. 12 which additionally shows an optional sleeve 308 disposed around the assembly formed by the tubes 304 and the liquid distribution tube 306 to form a tube-within-a-tube construction. In FIG. 12, the liquid distribution tube 306 is represented by the dashed line extending the length of the sleeve 308. The dashed line is not intended to imply that the liquid distribution tube is broken into sections or is discontinuous.

The liquid distribution tube 306 includes a plurality of spray holes formed therein through which the second fluid is sprayed 310 as shown by the arrows. Any number or configuration of spray holes can be used. Preferably, the spray holes are arranged so that the second fluid sprays 310 in substantially 360 degrees in all directions to impinge on the three tubes 304. It is to be realized that more or less than three tubes 304 can be helically wound around the liquid distribution tube 306.

Returning to FIG. 11, a hexagonal arrangement 312 of the twisted tube concept is illustrated and shown more fully in FIG. 13. In the hexagonal arrangement 312, a tube within a tube concept is provided similar to the single arrangement shown in FIG. 12, wherein a hexagonal pattern of six tubes-within-tubes assemblies 314 are used. Each assembly 314 includes a plurality of tubes 316, for example three tubes, helically twisted about a central liquid distribution tube 318, with the tubes 316 and the tube 318 disposed within a larger fluid carrying tube 320. The liquid distribution tube 316 includes a plurality of spray holes formed therein through which the second fluid is sprayed 320 as shown by the arrows in FIG. 13. Any number or configuration of spray holes can be used. Preferably, the spray holes are arranged so that the second fluid sprays 320 in substantially 360 degrees in all directions to impinge on the three tubes 316. It is to be realized that more or less than three tubes 316 can be helically wound around the liquid distribution tube 318.

Figure 14:
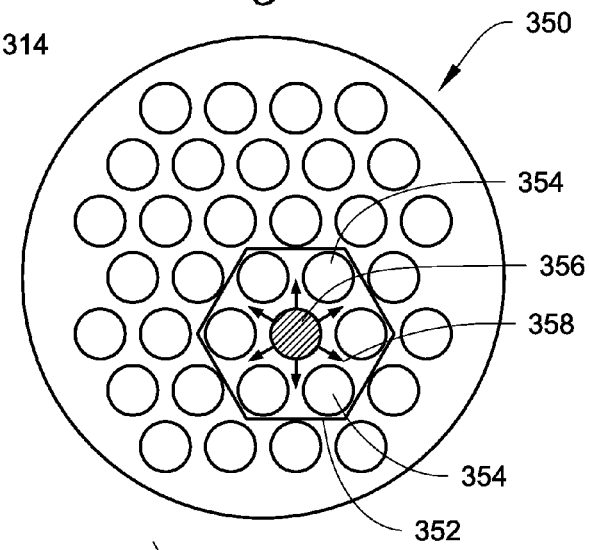
FIG. 14 is a cross-sectional view of still another embodiment of the use of a liquid distribution tube.
Figure 15:
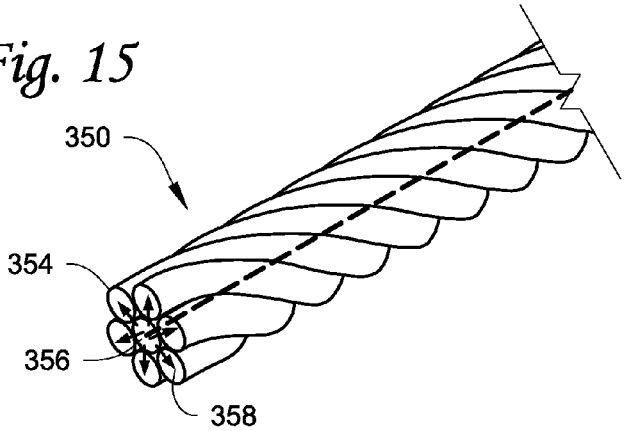
FIG. 15 is a partial, isometric view of the portion within the hexagon in FIG. 14.

FIGS. 14-15 illustrate another embodiment of the twisted tube concept, where a tube bundle 350 is illustrated as including a hexagonal arrangement 352 of six tubes 354 helically wound around a central liquid distribution tube 356 that is configured to spray 358 liquid outwardly onto the tubes 354.

This twisted tube and liquid distribution tube concept can be used by itself or in combination with any of the embodiments previously described herein. For example, with reference to FIG. 13, one or more of the liquid distribution tubes 318 can be replaced with a solid body of foam 322 forming a heat transfer unit.

In addition, instead of being twisted helically around the liquid distribution tube, the tubes 316, 354 can be straight and linear, but nonetheless disposed around the liquid distribution tube so that the sprayed liquid impinges on the tubes. Further, whether helically twisted or straight, each tube 316, 354 can be twisted about its own axis.

Figure 16A:
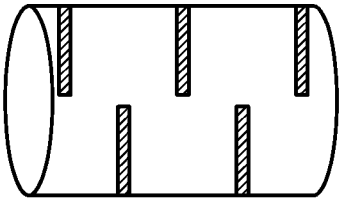
Figure 16B:
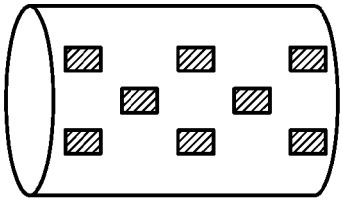
Figure 16C:
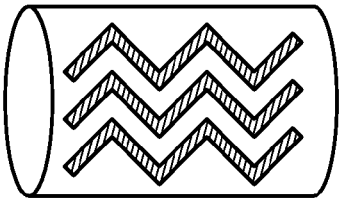
Figure 16D:
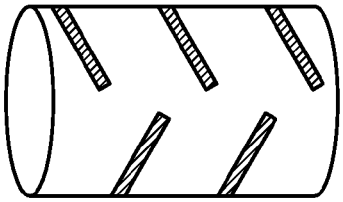
Figure 16E:
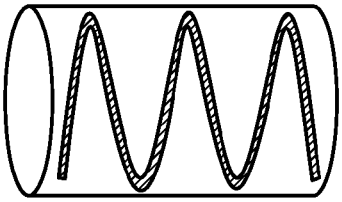
Figure 16F:
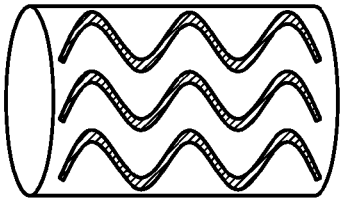

When foam heat transfer units are used, the heat transfer units can be arranged and grouped in a number of different manners. FIGS. 16A-F illustrate examples of patterns formed by different configurations of foam heat transfer units that can be utilized. For example, as shown in FIG. 16A, the heat transfer units can be arranged into a baffled "offset" configuration. FIG. 16B shows the heat transfer units arranged disposed in an offset configuration. When viewed from the top, each of the heat transfer units may have the shape of, but not limited to, square, rectangular, circular, elliptical, triangular, diamond, or any combination thereof. FIG. 16C shows the heat transfer units arranged into a triangular-wave configuration. Other types of wave configurations, such as for example, square waves, sinusoidal waves, sawtooth waves, and/or combinations thereof are also possible. FIG. 16D shows the heat transfer units arranged into an offset chevron configuration. FIG. 16E shows the heat transfer units arranged into a large helical spiral. FIG. 16F shows the heat transfer units arranged into a wavy arrangement or individual helical spirals.

The first and second fluids can be either liquids, gases/vapor, or binary mixtures thereof. One example of a first fluid is water, such as sea water, and one example of a second fluid is ammonia in liquid form. An exemplary application of the heat exchange evaporators described herein is in an Ocean Thermal Energy Conversion system.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heat exchange evaporator, comprising:
- a shell having a longitudinal axis;
- a tube bundle disposed within the shell, the tube bundle comprising:
  - a plurality of first tubes configured to convey a first fluid;
  - a first tube sheet; and
  - a second tube sheet, wherein the plurality of first tubes are arranged parallel to the longitudinal axis, each of the plurality of first tubes comprising:
    - an outer surface;
    - a first end joined to the first tube sheet in a manner to prevent fluid leakage between the first end and the first tube sheet; and
    - a second end joined to the second tube sheet in a manner to prevent fluid leakage between the second end and the second tube sheet;
- a heat transfer member connected to and in thermal contact with the outer surfaces of the plurality of first tubes, the heat transfer member configured to provide a downward cross-flow, the heat transfer member comprising graphite foam;
- and
- a liquid distribution tube disposed within the shell parallel to the longitudinal axis, the liquid distribution tube is configured to spray a second liquid within the shell and cascade over the heat transfer member in a downward cross-flow pattern.

2. The heat exchange evaporator according to claim 1, wherein the first end and the second end of each first tube of the plurality of first tubes are joined to the first tube sheet and the second tube sheet respectively by friction-stir welded joints.

3. The heat exchange evaporator according to claim 1, wherein the shell, the first tube sheet, and the second tube sheet collectively define a chamber that contains the plurality of first tubes, the heat transfer member and the liquid distribution tube.

4. The heat exchange evaporator according to claim 1, wherein the heat transfer member consists of graphite foam.

5. The heat exchange evaporator according to claim 1, wherein the heat transfer member comprises a plurality of heat transfer members axially spaced from one another along the longitudinal axis of the shell.

6. The heat exchange evaporator according to claim 1, wherein the heat transfer member is bonded to the outer surfaces of the plurality of first tubes with a thermally conductive adhesive.

7. The heat exchange evaporator according to claim 6, comprising conductive ligaments disposed within the thermally conductive adhesive, the conductive ligaments being in intimate contact with the outer surfaces.

8. The heat exchange evaporator according to claim 1, wherein the liquid distribution tube comprises a plurality of liquid distribution tubes.

9. The heat exchange evaporator according to claim 8, wherein each of the plurality of liquid distribution tubes extends through a respective opening in the heat transfer member.

10. The heat exchange evaporator according to claim 8, wherein at least one of the plurality of liquid distribution tubes is disposed above the tube bundle, and at least one of the plurality of liquid distribution tubes is disposed within the tube bundle.

11. The heat exchange evaporator according to claim 8, wherein the plurality of liquid distribution tubes are disposed within the tube bundle.

12. The heat exchange evaporator according to claim 5, wherein each of the heat transfer members has a substantially wedge-shaped body, and the plurality of the heat transfer members are configured to form a baffle assembly around the plurality of first tubes.

13. The heat exchange evaporator according to claim 12, further comprising a metal plate joined to at least one of the heat transfer members.

14. The heat exchange evaporator according to claim 12, wherein the baffle assembly forms a substantially helix-shape.

15. The heat exchange evaporator according to claim 1, wherein the tubes of the plurality of first tubes are disposed so as to surround the liquid distribution tube, the liquid distribution tube configured to spray the second fluid therefrom in multiple directions so as to impinge on the outer surfaces of the tubes of the plurality of first tubes.

16. The heat exchange evaporator according to claim 1, wherein the longitudinal axis of the shell and the plurality of first tubes are oriented horizontally or vertically.

17. The heat exchange evaporator according to claim 1, wherein the plurality of first tubes and the liquid distribution tube are made of metal.

18. The heat exchange evaporator according to claim 1, wherein the liquid distribution tube has an end that penetrates and is directly attached to the first tube sheet and an opposite end that penetrates and is directly attached to the second tube sheet.

19. The heat exchange evaporator according to claim 8, wherein the plurality of liquid distribution tubes are cylindrical.

20. The heat exchanger evaporator of claim 1, wherein the heat transfer member comprises a perimeter edge coupled to an interior surface of the shell around an entire interior perimeter of the shell.

21. A heat exchange evaporator, comprising:

a shell having a longitudinal axis;

a tube bundle disposed within the shell, the tube bundle comprising:

a plurality of first tubes configured to convey a first fluid;

a first tube sheet; and a second tube sheet, wherein the plurality of first tubes are arranged parallel to the longitudinal axis, each of the plurality of first tubes comprising:

an outer surface;

a first end joined to the first tube sheet in a manner to prevent fluid leakage between the first end and the first tube sheet; and a second end joined to the second tube sheet in a manner to prevent fluid leakage between the second end and the second tube sheet;

a plurality of circular heat transfer members, each circular heat transfer member connected to and in thermal contact with the outer surfaces of the plurality of first tubes, each of the circular heat transfer members comprising graphite foam, wherein the circular heat transfer members are axially spaced from one another along the tube bundle; and a liquid distribution tube disposed within the shell parallel to the longitudinal axis, the liquid distribution tube is configured to spray a second liquid within the shell, the liquid distribution tube having a first diameter, wherein each of the circular heat transfer members includes a plurality of tube openings therethrough, each of the plurality of first tubes extending through and in contact with a respective one of the plurality of tube openings, wherein each of the circular heat transfer members further includes at least one fluid conducting opening therethrough to permit fluid communication between opposite sides of the circular heat transfer member, the liquid distribution tube extending through the fluid conducting opening, wherein each fluid conducting opening has a second diameter larger than the first diameter of the liquid distribution tube, thereby forming a gap between the liquid distribution tube and the fluid conducting opening for fluid communication through the gap.

22. The heat exchange evaporator according to claim 21, wherein each of the circular heat transfer members includes a funnel-shaped, concave portion surrounding the fluid conducting opening.

23. A heat exchanger tube bundle, comprising:

a first tube sheet and a second tube sheet spaced from the first tube sheet;

a fluid distribution tube configured to spray a fluid in multiple directions therefrom, the fluid distribution tube having an end that penetrates and is directly attached to the first tube sheet and an opposite end that penetrates and is directly attached to the second tube sheet;

a plurality of fluid carrying tubes disposed around the fluid distribution tube, wherein fluid sprayed from the fluid distribution tube is configured to impinge on outer surfaces of the plurality of fluid carrying tubes, each fluid carrying tube having an end that penetrates and is directly attached to the first tube sheet and an opposite end that penetrates and is directly attached to the second tube sheet; and a circular foam heat transfer member connected to and in thermal contact with the plurality of fluid carrying tubes, the circular foam heat transfer member comprising a circular outer perimeter edge configured to prevent flow of the fluid between the outer perimeter edge and an interior surface of a shell.

24. The heat exchanger tube bundle according to claim 23, wherein the plurality of fluid carrying tubes are helically twisted about the fluid distribution tube.

25. The heat exchanger tube bundle according to claim 23, wherein the fluid distribution tube and the plurality of fluid carrying tubes are made of metal; the first tube sheet and the second tube sheet are made of a metal; the metal of the fluid distribution tube and the plurality of fluid carrying tubes and the metal of the first tube sheet and the second tube sheet are the same; the ends of the fluid carrying tubes are friction stir welded to the first and second tube sheets; and the ends of the fluid distribution tube are friction stir welded to the first and second tube sheets.

26. The heat exchanger tube bundle according to claim 23, wherein the fluid sprayed by the fluid distribution tube is a liquid, and the fluid carried by the fluid carrying tubes is a liquid.

27. A heat transfer member for use in a heat exchanger, comprising:

a body that consists essentially of graphite foam material, the body including first and second major surfaces and a perimeter edge, the perimeter edge being devoid of openings therethrough;

a plurality of tube openings extending through the body from the first major surface to the second major surface, the tube openings having central axes that are parallel to each other, each tube opening configured to connect to an outer surface of a heat exchange tube for establishing thermal contact between the graphite foam material and the heat exchange tube; and a fluid conducting opening extending through the body from the first major surface to the second major surface, the fluid conducting opening having a central axis that is parallel to the central axes of the tube openings.

28. The heat transfer member of claim 27, further comprising a funnel-shaped, concave portion formed in the first major surface or the second major surface and surrounding the fluid conducting opening.

29. The heat transfer member of claim 27, wherein the fluid conducting opening comprises a plurality of fluid conducting openings.

* * * * *